United States Patent [19]

Okada et al.

[11] Patent Number: 4,755,721

[45] Date of Patent: Jul. 5, 1988

[54] HIGH PRESSURE SODIUM VAPOR LAMP HAVING UNSATURATED VAPOR PRESSURE TYPE CHARACTERISTICS

[75] Inventors: Toshiyuki Okada, Ageo; Hiroyoshi Yokome; Akira Kosasa, both of Gyoda; Tomoyuki Habu, Kawaguchi; Yasuharu Yamamoto, Kitamoto, all of Japan

[73] Assignee: Iwasaki Electric Co., Ltd., Tokyo, Japan

[21] Appl. No.: 26,331

[22] Filed: Mar. 16, 1987

[51] Int. Cl.[4] ..... H01J 61/20

[52] U.S. Cl. ..... 313/639; 313/571; 313/642

[58] Field of Search ..... 313/571, 637, 638, 639, 313/642; 445/38, 53

[56] References Cited

U.S. PATENT DOCUMENTS 3,453,477 7/1969 Hanneman ..... 313/571
4,075,530 2/1978 Furukubo et al. ..... 313/318 X

FOREIGN PATENT DOCUMENTS 0123397 10/1984 European Pat. Off. .

OTHER PUBLICATIONS

*IEEE Proceedings*, vol. 128, No. 6, Sep. 1981, pp. 415–441, Old Woking, Surrey, Great Britain, Van Vliet et al.: "High Pressure Sodium Discharge Lamps".

*Primary Examiner*—David K. Moore
*Assistant Examiner*—K. Wieder
*Attorney, Agent, or Firm*—Armstrong, Nikaido, Marmelstein & Kubovcik

[57] ABSTRACT

This invention discloses a high pressure sodium vapor lamp having unsaturated vapor pressure type characteristics with sodium and mercury contained in an arc tube. The sodium is enclosed in an amount sufficient to exhibit unsaturated vapor pressure type characteristics while the mercury is enclosed in an amount $M_{Hg}$ calculated by the following formula:

$$M_{Hg} \geqq \frac{D^3 \times V_n^2}{(0.204 \times V_{olume} + 13.3)^2 \times L}$$

where $M_{Hg}$: the amount of mercury enclosed (mg)
D: the internal diameter of the arc tube (cm)
L: the electrode-to-electrode distance (cm)
$V_{olume}$: the volume of the arc tube (cc)
$V_n$: the rated lamp voltage (Volt).

3 Claims, 2 Drawing Sheets

HIGH PRESSURE SODIUM VAPOR LAMP HAVING UNSATURATED VAPOR PRESSURE TYPE CHARACTERISTICS

BACKGROUND OF THE INVENTION

1. Field of the Invention

The present invention pertains to a high pressure sodium vapor lamp having unsaturated vapor pressure type characteristics with improved lamp voltage fluctuation characteristics.

2. Description of the Prior Art

High pressure sodium vapor lamps have heretofore been known which typically utilize luminescence caused by electric discharge in a high pressure sodium vapor. An arc tube for use with this type of high pressure sodium vapor lamp is commonly exposed to the high temperature sodium vapor during a burning operation. For this reason, an alumina ceramic tube is generally used which has an adequate capacity to endure the effects of the high temperature sodium vapor and yet which exhibits a transmission factor of 90% or more with respect to visible light. In addition to sodium and mercury, xenon as a starting gas is enclosed in the interior of the alumina ceramic tube.

Referring to FIG. 1 which illustrates an arc tube 10 for use in a conventional high pressure sodium vapor lamp, a translucent alumina ceramic tube 1 has opposite end caps 2 and 3 made of alumina, the end caps 2 and 3 being respectively hermetically bonded to both ends of the tube 1 by means of frit. Through holes formed in the centers of the respective end caps 2 and 3 receive electrode support tubes 4 and 5 made of niobium, the tubes 4 and 5 being likewise hermetically bonded to the through holes by means of frit. Electrodes 6 and 7 are secured to the inner ends of the electrode support tubes 4 and 5. The electrode support tube 4 used as an exhaust tube is provided with an exhaust hole 4*a* while the electrode support tube 5 on the non-exhaust side is provided with a passage hole 5*a* for preventing air from being sealed within the tube 5. Prior to the sealing of the electrode support tube 4 used as an exhaust tube, a sodium amalgam 8 is enclosed therein.

The arc tube 10 having the above-described structure is, as shown in FIG. 2, supported by support wires 12 or the like in an outer bulb 11, thereby constituting a high pressure sodium vapor lamp 20. An auxiliary conductor 13 serving as an external start-up element is additionally disposed around the periphery of the arc tube 10, and bimetal switches 14 and 15 function to break the electrical continuity of the auxiliary conductor 13 during the burning operation of the lamp.

However, while such a high pressure sodium vapor lamp is burning, the enclosed sodium may react with the translucent alumina arc tube, the sealing frit for the arc tube or an emitter disposed on its electrode. Alternatively, the enclosed sodium may be physically adsorbed by these elements or diffused in the frit. In consequence, the sodium which contributes to the luminescence of the lamp progressively disappears. In order to compensate for this loss of sodium, it has been general practice for the amalgam enclosed in the arc tube to be composed of sodium and mercury in amounts above what would normally contribute to the luminescence, thereby constituting a high pressure sodium vapor lamp of a saturated vapor pressure type.

As described above, such high pressure sodium vapor lamps of the saturated vapor pressure type include an excessive amount of enclosed sodium amalgam. Therefore, if a lamp of this type is disposed in a place susceptible to vibration or in equipment having an airtight structure, factors such as vibration or temperature rise lead to an increase in the sodium vapor pressure and the consequent disadvantage of variations in the lamp characteristics. As regards the ballast that is used in a lighting circuit, both the type which is dedicated for use with high pressure sodium vapor lamps and the low-price ballast utilized in mercury vapor lamps may be employed. In the latter case, however, since only the use of a choke type ballast is allowed, it is impossible to employ a constant power consumption type of ballast having a simple construction in which a capacitor is connected in series. More specifically, although high pressure sodium vapor lamps generally exhibit a rise in lamp voltage toward the end of their service life, use of the constant power consumption type of ballast means that the consumption of power rises as the lamp voltage increases. Since this phenomenon involves excessive power input which might entail breakage of the lamp, it is impossible to use the constant power consumption type of ballast.

On the other hand, an unsaturated vapor pressure type of high pressure sodium vapor lamp is known which enjoys a range of usage that is not limited to particular kinds of equipment and which can be utilized in locations that are susceptible to vibration. In addition, a lamp of this type can be used not only with a choke type ballast of the kind used for mercury vapor lamps but also with a constant power consumption type of ballast. A typical high pressure sodium vapor lamp of the unsaturated vapor pressure type is constructed in such a manner that a limited amount of amalgam composed of sodium and mercury is enclosed in the arc tube and, while the lamp is burning, it assumes a state wherein all the sodium amalgam enclosed therein is vaporized.

Since, however, the amount of sodium enclosed in the arc tube of the unsaturated type high pressure sodium vapor lamp is, as described above, only sufficient to allow for vaporization of all the sodium while burning, the sodium progressively disappears during the burning operation of the lamp, thereby leading to a drop in the lamp voltage. In addition, the influence exerted on the lamp voltage in this way is remarkable as compared with that of the previously-described saturated type high pressure sodium vapor lamp.

When the sodium in the arc tube is completely gone, the mercurcy alone emits light, that is, the arrangement substantially equals that of a high pressure mercury vapor lamp. The lamp voltage is increased to about the level of the initial lamp voltage. However, at an intermediate point before the sodium is completely gone, i.e., while a trace of sodium is still present, the lamp voltage reaches a minimum value. If the lamp voltage drops by an excessive degree when reaching this minimum value, there is a problem in that there is a risk of the ballast burning.

SUMMARY OF THE INVENTION

It is therefore an object of the present invention to provide a high pressure sodium vapor lamp having unsaturated vapor pressure type characteristics which succeeds in solving the above-described problems encountered with high pressure sodium vapor lamps of the conventional unsaturated vapor pressure type, and in which, even if the sodium enclosed in an arc tube thereof is gone, the lamp voltage is prevented from falling below a predetermined limit, thereby eliminating the risk of damaging ballast.

To this end, the present invention provides a high pressure sodium vapor lamp having unsaturated vapor pressure type characteristics with sodium and mercury contained in an arc tube made of translucent alumina, the sodium being enclosed in an amount sufficient to exhibit the unsaturated vapor pressure type characteristics while the mercury is enclosed in an amount calculated by the following formula:

$$M_{Hg} \geqq \frac{D^3 \times V_n^2}{(0.204 \times V_{olume} + 13.3)^2 \times L}$$

where $M_{Hg}$: the amount of mercury enclosed (mg)

D: the internal diameter of the arc tube (cm)

L: the electrode-to-electrode distance (cm)

$V_{olume}$: the volume of the arc tube (cc)

$V_n$: the rated lamp voltage (Volt).

As a consequence, even if the sodium in the arc tube progressively disappears, the lamp voltage is prevented from falling below a level equivalent to 70% of the rated lamp voltage, thereby preventing the ballast used from being damaged.

Further objects, features and advantages of the present invention will become apparent from the following description of various embodiments and examples of the present invention with reference to the accompanying drawings.

DETAILED DESCRIPTION OF THE INVENTION

Figure 1:
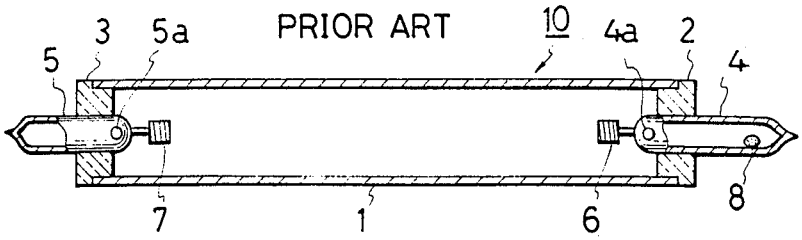
FIG. 1 PRIOR ART
FIG. 1 is a cross-sectional view of a typical arc tube for high pressure sodium vapor lamps.
Figure 2:
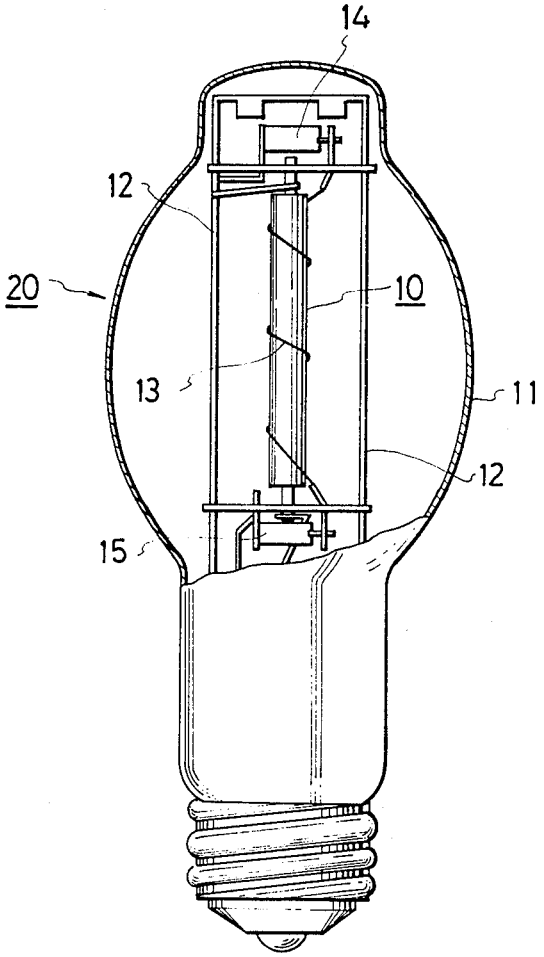
FIG. 2 PRIOR ART
FIG. 2 is a partially cross-sectional view of a typical high pressure sodium vapor lamp incorporating the arc tube shown in FIG. 1.

In general, the suitable range of the lamp voltage of a high pressure sodium vapor lamp is within ±10 to 15% of a rated lamp voltage thereof by considering variation factors in production. For example, in the case of a lamp having a rated lamp voltage of 130V, the suitable range of the lamp voltage is 130±15V. If the lamp voltage is excessively high, the lamp comes to easily extinguish. On the other hand, if the lamp voltage is excessively low, the lamp does not extinguish, and continues to burn. However, as described above, if the lamp continues to burn for a long period of time in this state, an overcurrent flows in a choke type ballast employed and thus its coil get burnt. In the case of the constant power consumption type ballast, an overvoltage is applied to its capacitor and this produces various difficulties.

It has generally been confirmed that, when the lamp voltage of the high pressure sodium vapor lamp decreases, if the minimum lamp voltage does not normally fall below a level equivalent to 70% or more of the rated lamp voltage, such voltage drop does not produce material difficulties such as burning even in the case of standard ballast which is not specially designed.

In general, the configuration of an arc tube is determined and then sodium and mercury are respectively enclosed in the arc tube in predetermined amounts corresponding to the configuration thus determined. When a lamp using the thus-prepared arc tube is made to burn through the ballast, the unsaturated type high pressure sodium vapor lamp typically provides a certain level of lamp voltage. The present inventors conducted the following experiment in connection with such an arc tube incorporated in the unsaturated type high pressure sodium vapor lamp. More specifically, we experimentally produced various unsaturated types of high pressure sodium vapor lamp by changing the amount of enclosed sodium with maintaining the amount of enclosed mercury at a constant level, and measured the lamp voltages of the lamps thus prepared. It was discovered from the results that the lamp voltage shows a value proportional to the amount of enclosed sodium. However, when this amount remarkably decreases, the lamp voltage showed values independent of such proportional relationship. When the sodium amount was further reduced, the lamp voltage conversely increased, so that it was found that the lamp voltage shows a minimum valve immediately before such increase.

In addition, the amount of mercury enclosed in the arc tube was changed and fluctuations in the lamp voltage were measured while the amount of enclosed sodium was being changed in relation to the respective varied amounts of enclosed mercury in the same manner as the aforesaid experiment. It was found from this experiment that the lamp voltage shows a tendency to fluctuate in proportional relation to variations in the amount of enclosed sodium in the same manner as the previously described experiment and that, as the amount of enclosed mercury is decreased, the lamp voltage also falls.

Figure 3:
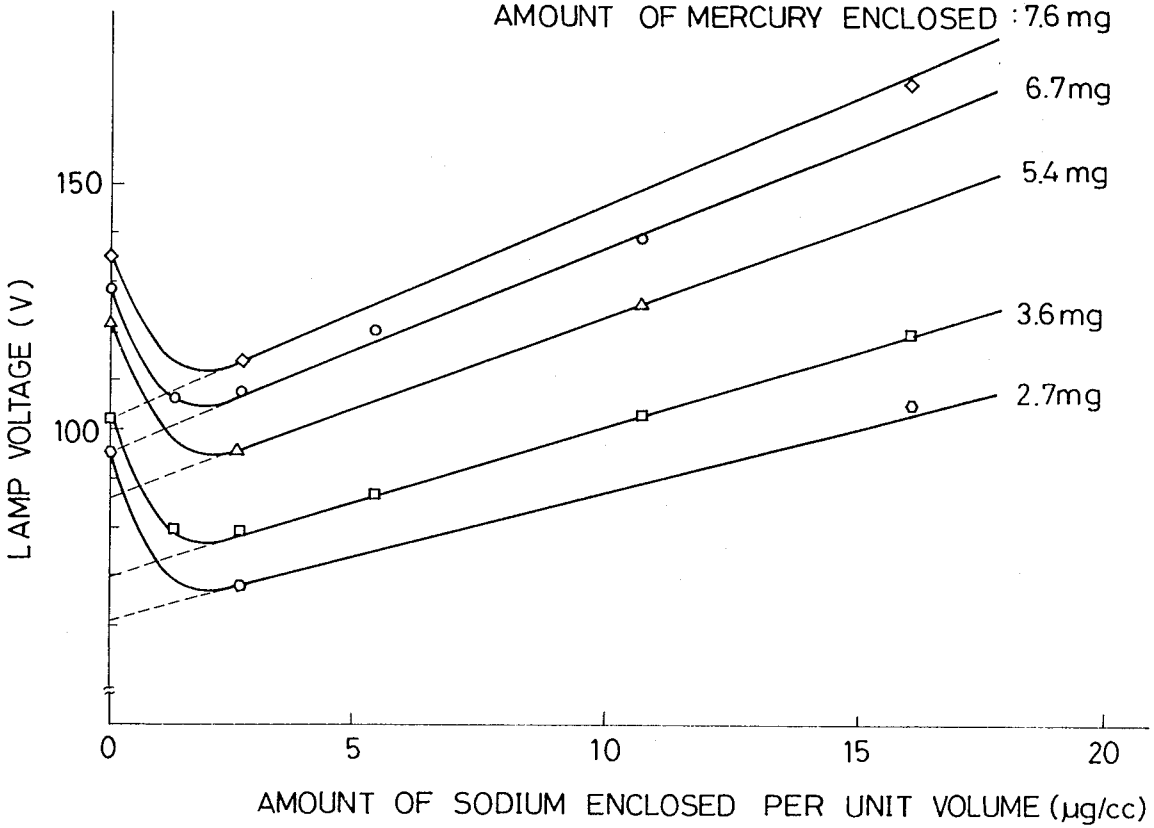
FIG. 3 is a chart of characteristic curve showing variations in lamp voltage relative to the amount of sodium enclosed per unit volume under the condition that the amount of mercury enclosed is fixed.

FIG. 3 is a chart of the amount of enclosed sodium vs lamp voltage characteristic curves. The amount of mercury enclosed in an unsaturated type high pressure sodium vapor lamp was varied to 7.6 mg, 6.7 mg, 5.4 mg, 3.6 mg and 2.7 mg, respectively, the amount of enclosed sodium (the amount enclosed per unit volume) was changed from 0 to about 16 μg/cc in association with the respective amounts of enclosed mercury, and variations in the lamp voltage were measured. The specifications of the unsaturated type high pressure sodium vapor lamp were: the rated power consumption, 360 W (in a 400 W type); the internal diameter of the arc tube, 8.0 mm; the length of the arc tube, 110 mm; the electrode-to-electrode distance (arc length), 84 mm; the xenon pressure, 150 Torr; the volume in the arc tube, 5.23 cc; and the rated lamp voltage, 130V. Incidentally, about 12 μg/cc of sodium is typically enclosed in a 360 W unsaturated type of high pressure sodium vapor lamp.

As can be seen from the amount of enclosed sodium-lamp voltage characteristic chart, if the amount of enclosed mercury is constant, the lamp voltage is proportional to the amount of enclosed sodium. When the amount of enclosed sodium is extremely small, in this example below about 2 μg/cc (equivalent to about 0.01 mg or less in the total amount of enclosed sodium), the proportional relationship collapses and, in the vicinity of the aforesaid amount of enclosed sodium, the lamp voltage reaches a minimum value. If the amount of enclosed sodium is further reduced, the lamp voltage increases conversely. This is because, when the amount of sodium decreases, electric discharge is finally effected through the medium of mercury alone.

In addition, two kinds of arc tubes were prepared for lamps having the same specifications: one was constructed to contain 0.084 mg sodium and 3.6 mg mercury in an enclosed manner, while the other was constructed to contain 0.056 mg sodium and 6.7 mg mercury in an enclosed manner. In addition, when the arc tubes were to be sealed with sealing members, the sealing temperatures were suitably adjusted so that the sodium would easily disappear. The thus-obtained arc tubes were subjected to, e.g., a step of burning them under overloaded conditions in order to perform an acceleration test. It was thus confirmed that, as the burning time passed, the lamps showed lamp voltage characteristics similar to the amount of sodium-lamp voltage characteristic curves shown in FIG. 3. Specifically, it was confirmed that, since the sodium alone progressively disappeared as the burning time passed, the lamp voltage shifted along the characteristic curves corresponding to 3.6 mg and 6.7 mg of the amount of enclosed mercury from right to left as viewed in FIG. 3 being a chart of lamp voltage characteristic curves, that is, in the direction in which the amount of enclosed sodium decreases.

In consequence, the lamp incorporating the arc tube in which 3.6 mg mercury was enclosed showed an initial lamp voltage of 119V and a minimum lamp voltage of 78V while the other lamp incorporating the arc tube in which 6.7 mg mercury was enclosed showed an initial lamp voltage of 138V and a minimum lamp voltage of 106V. It was confirmed that the characteristics of these lamps substantially coincided with those of the examples plotted in FIG. 3 in respect of the minimum lamp voltages as well.

In addition, a 400-W unsaturated type of high pressure sodium vapor lamp was subjected to similar experiments, the lamp being of the type which had a rated lamp voltage of 135V under U.S. standards. The results obtained from these experiments were substantially the same as the characterictics shown in FIG. 3.

The following empirical formula is obtained from the foregoing experiments, the empirical formula relating to the amount of enclosed mercury $M_{Hg}$ (mg) which enables the minimum value of lamp voltage to be held at a level equivalent to 70% or more of the rated lamp voltage even if the sodium enclosed in the arc tube progressly disappears as the burning time passes.

$$M_{Hg} \geqq \frac{D^3 \times V_n^2}{(0.204 \times V_{olume} + 13.3)^2 \times L} \quad (1)$$

where

D: the internal diameter of the arc tube (cm)

L: the electrode-to-electrode distance (arc length) (cm)

$V_{olume}$: the volume of the arc tube (cc)

Vn: the rated lamp voltage (Volt).

The process of arriving at the empirical formula (1) is as follows.

In general, the following approximate formula (2) relating to a lamp voltage Vl of mercury arc lamps is known:

$$Vl \propto \sqrt{\frac{L \times M_{Hg}}{D^3}} \quad (2)$$

The formula (2) is applied to calculation of the lamp voltage Vl of a high pressure sodium vapor lamp which employs an arc tube in which an amalgam composed of sodium and mercury is enclosed, and the following formula (3) is obtained from the characteristic curves plotted in FIG. 3:

$$Vl = (a + b\,M_{NA})\sqrt{\frac{L \times M_{Hg}}{D^3}} \quad (3)$$

where a and b are the constants and $M_{NA}$ is the amount of enclosed sodium (mg).

On the basis of the data representing the characteristic curves plotted in FIG. 3, the constants a and b in the above formula (3) are calculated, so that the following formula (4) is obtained:

$$Vl = (9.3 + 75\,M_{NA})\sqrt{\frac{L \times M_{Hg}}{D^3}} \quad (4)$$

In order to adapt the formula (4) for the calculations of lamps rated at different watts, formula (5) is obtained by substituting density for the amount of enclosed sodium $M_{NA}$:

$$Vl = \left(9.3 + 75 \times \frac{M_{NA}}{5.23} \times V_{olume}\right) \times \sqrt{\frac{L \times M_{Hg}}{D^3}} \quad (5)$$

where 5.23 is the volume (cc) of the arc tube of a 360W lamp and $V_{olume}$ is the volume (cc) of the arc tube rated at another given wattage.

Then, if the amount of enclosed mercury $M_{Hg}$ is obtained from the formula (5), formula (6) becomes:

$$M_{Hg} = \frac{V^2}{\{9.3 + 75 \times (M_{NA}/5.23) \times V_{olume}\}^2} \times \frac{D^3}{L} \quad (6)$$

Accordingly, as is evident from the previously cited experiments, when the amount of enclosed sodium is (2 μg/cc)×5.23 cc=0.01 mg, the lamp voltage Vl of the 360W lamp reaches a minimum level. Also, a minimum lamp voltage $Vl_{min}$ which ensures safe operation of the ballast used in the lighting circuit is a level equivalent to 70% or more of a rated lamp voltage $V_n$. Therefore, the amount of enclosed mercury $M_{Hg}$ required to determine the safe level of the minimum lamp voltage ($V_n \times 0.7$) is obtained from the following formula (7):

$$M_{Hg} \geqq \frac{(0.7 \times V_n)^2}{\{9.3 + 75 \times (0.01/5.23) \times V_{olume}\}^2} \times \frac{D^3}{L} \quad (7)$$

The previously noted formula (1) is obtained by adjusting the formula (7).

When mercury is enclosed in the arc tube in an amount to satisf $M_{Hg}$ of the formula (1), even if the sodium progressively disappears as the burning time passes, the lamp voltage never falls below a level equivalent to 70% or more of the rated lamp voltage. In consequence, it becomes possible to prevent ballast from being burnt or damaged.

In general, when the level of lamp voltage is excessively high, use of a choke type ballast, as previously described, leads to the extinguishment of a lamp while use of a constant power consumption type of ballast involves excessive power input, thereby entailing breakage of the lamp. For this reason, it is preferred that the maximum lamp voltage is not more than about 1.3 times the rated lamp voltage. However, the lamp voltage of a typical unsaturated type of high pressure sodium vapor lamp is not caused to increase by the disappearance of sodium, but conversely has a tendency for the lamp voltage to decrease. Therefore, if the initial value of the lamp voltage is selected so as to become not more than 1.3 times the rated lamp voltage $V_n$, the level of the lamp voltage never exceed the initial value setting during a burning operation. In consequence, it is unnecessary to too much consider the upper limit of the lamp voltage. It is to be noted that, in cases where the initial value of the lamp voltage is selected so as to become not more than 1.3 times the rated lamp voltage, the upper limit of the amount of enclosed mercury can be easily set according to the selected value in association with the normal design of high pressure sodium lamps.

DESCRIPTION OF THE PREFERRED EMBODIMENTS

The following description concerns a high pressure sodium vapor lamp having unsaturated vapor pressure type characteristics which was prepared on the basis of the aforesaid empirical formula (1) in accordance with the present invention.

First, description will be made as to a preferred embodiment in which the present invention is applied to an unsaturated type high pressure sodium vapor lamp having a rated power consumption of 150 W. This lamp rated at a power consumption of 150 W includes an arc tube having an internal diameter of 5.3 mm, a length of 66 mm, a volume of 1.32 cc, an electrode-to-electrode distance (arc length) of 46 mm and a xenon pressure of 150 Torr, and the rated lamp voltage is 130V. The allowable minimum lamp voltage of the lamp constructed in accordance with these specifications is $130\times0.7=91$V, and the amount of enclosed mercury $M_{Hg}$ required to obtain this allowable minimum lamp voltage is represented by $M_{Hg}\geqq2.97$ mg from the previously noted empirical formula (1).

In order to provide a lamp voltage equivalent to the allowable minimum lamp voltage or more at the arc tube prepared in accordance with the above specifications, mercury was enclosed in an amount of 3.2 mg which was within the range determined by the empirical formula (1). In consequence, the minimum value of the lamp voltage was 100V. In addition, in a case where 3.0 mg mercury was enclosed in the arc tube, the minimum value of the lamp voltage was 92V. In either case, it was actually confirmed that the minimum value of the lamp voltage was equal to or more than the allowable value (91V).

For the sake of comparison, mercury was enclosed in an arc tube in an amount of 2.0 mg which was below the amount obtained from the empirical formula (1), and the minimum lamp voltage of the thus-prepared arc tube measured 80V. Specifically, the minimum lamp voltage fell below the allowable minimum lamp voltage (91V).

As described above, it was confirmed that, if the amount of enclosed mercury was selected so as to satisfy the conditions of the aforesaid empirical formula (1), a 150-W class lamp was also able to be arranged so that its rated lamp voltage would not fall below the allowable limit.

The following description concerns another preferred embodiment in which the present invention is applied to an unsaturated type high pressure sodium vapor lamp having a rated power consumption of 220 W (250-W class). The specifications of this lamp are as follows:

the internal diameter of the arc tube: 6.6 mm
the length of the arc tube: 90 mm
the volume of the arc tube: 2.87 cc
the electrode-to-electrode distance (arc length): 67 mm
the xenon pressure: 150 Torr
the rated lamp voltage: 130V.

The allowable minimum lamp voltage of the lamp constructed in accordance with the above noted specifications is $130\times0.7=91$V. The amount of enclosed mercury $M_{Hg}$ required to provide this allowable lamp voltage is represented by $M_{Hg}\geqq3.76$ mg from the empirical formula (1).

In this embodiment, in order to maintain the minimum lamp voltage at a level equivalent to the allowable limit or more, the arc tube having the aforesaid specifications was prepared by enclosing therein 4.0 mg mercury which was more than the limit calculated from the empirical formula (1). The minimum lamp voltage measured 98V, and it was thus confirmed that it was actually more than the allowable value (91V). In addition, 3.8 mg mercury was enclosed in an arc tube and the minimum lamp voltage of the thus-prepared arc tube was measured. The minimum lamp voltage was 91V, and in this case it was also confirmed that it was equal to the allowable value.

For the sake of comparison, mercury was enclosed in an arc tube in an amount of 3.2 mg which was less than the limit (3.76 mg). Its minimum lamp voltage measured 85V, and it was confirmed that it fell below the allowable value (91V).

As described above, it was confirmed that if the amount of enclosed mercury was selected so as to satisfy the conditions of the aforesaid empirical formula (1), the 250-W class lamp was also able to be arranged so that the minimum lamp voltage would be equal to or more than the allowable value.

The following description concerns still another preferred embodiment in which the present invention is applied to an unsaturated type high pressure sodium vapor lamp having a rated power consumption of 940 W (1-KW class). The specifications of this lamp are as follows:

the internal diameter of the arc tube: 9.0 mm
the length of the arc tube: 210 mm
the volume of the arc tube: 12.9 cc
the electrode-to-electrode distance (arc length): 180 mm
the xenon pressure: 150 Torr
the rated lamp voltage: 265V The allowable minimum lamp voltage of the lamp constructed in accordance with the above noted specifications is $265\times0.7=186$V. The amount of enclosed mercury $M_{Hg}$ required to provide this allowable lamp voltage is represented by $M_{Hg}\geqq11.2$ mg from the empirical formula (1).

In this embodiment, in order to maintain the minimum lamp voltage at a level equivalent to the allowable limit or more, the arc tube having the aforesaid specifications was prepared by enclosing therein 12 mg mercury which was more than the limit calculated from the empirical formula (1). The minimum lamp voltage measured 193V, and it was thus confirmed that it was actually more than the allowable value (186V).

For the sake of comparison, mercury was enclosed in an arc tube in an amount of 10 mg which was less than the limit obtained from the empirical formula (1). Its minimum lamp voltage measured 178V, and it was confirmed that it fell below the allowable value (186V).

As described above, it was confirmed that if the amount of enclosed mercury was selected so as to satisfy the conditions of the aforesaid empirical formula (1), the 1-KW class lamp was also able to be arranged so that the minimum lamp voltage would be equal to or more than the allowable value.

Although a cylindrical arc tube are used in each of the above-described embodiments, the same results can be achieved by use of an arc tube whose central portion in which an electric arc is formed has a large internal diameter and whose opposite ends each have a small diameter. In this case, the internal diameter of the arc tube may be the mean value of the internal diameters as between opposing electrodes.

Also, in the above-described examples and preferred embodiments, the present invention is applied to each of the 150W, 220W, 360W and 940W lamps. However, the present invention is not limited to the illustrative lamps, and can be applied to further various lamps rated at different watts.

The basic experiment conducted for obtaining the empirical formula (1) and the above-described embodiments based on it are aimed at high pressure sodium vapor lamps of the unsaturated vapor pressure type in which the sodium enclosed therein is completely vaporized during the burning operation. In addition, there are high pressure sodium vapor lamps of the type that has an arc tube in which sodium is enclosed in such an amount that, during the burning operation, the sodium is vaporized not completely but by 80% or more. This type of lamp also exhibits unsaturated vapor pressure type characteristics which allow use of a constant power consumption type of ballast commonly used for mercury vapor lamps. Therefore, the previously-mentioned empirical formula (1) according to the present invention is also applicable to such high pressure sodium vapor lamps in which the aforementioned amount of sodium is enclosed.

More specifically, if a lamp is provided with an arc tube in which sodium is enclosed in such an amount that 80% or more of the enclosed sodium is vaporized, the sodium progressively disappears as the burning time passes. Thus this type of lamp shows tendency for its lamp voltage to decrease. Subsequently, after a certain period of burning time has passed, the sodium that remains unvaporized also disappears, and this results in an unsaturated type high pressure sodium vapor lamp in which the sodium enclosed therein is completely vaporized. In consequence, this type of lamp exhibits completely the same amount of sodium-lamp voltage characteristics as those of the high pressure sodium vapor lamp of the unsaturated vapor pressure type in which the sodium enclosed therein is completely vaporized at the initial stage of operation. Accordingly, the aforesaid empirical formula (1) is applicable directly to the case where a lamp is provided with the arc tube in which sodium is enclosed in such an amount that 80% or more of the enclosed sodium is vaporized during the burning operation, and similar effects can be achieved. Incidentally, since about 12 μg/cc of sodium is enclosed in a high pressure sodium vapor lamp of a completely unsaturated type, this lamp is arranged to contain about 12 μg/cc÷0.8=15 μg/cc of enclosed sodium.

It is to be noted that a high pressure sodium vapor lamp of an imcompletely unsatured vapor pressure type in which less than 80% of sodium enclosed therein is vaporized during a burning operation requires a long period of time until the lamp is changed into a high pressure sodium vapor lamp of an unsaturated vapor pressure type in which the sodium enclosed therein is completely vaporized. This is not preferable in that the previously-described disadvantages of the saturated vapor pressure type lamp easily take place during such a long period of time.

As is evident from the above detailed description with illustrative reference to the basic examples and the preferred embodiments, the high pressure sodium vapor lamp having the unsaturated vapor pressure type characteristics according to the present invention is constructed in such a manner that mercury is enclosed in an arc tube thereof in a predetermined amount calculated by the empirical formula (1). In consequence, if the enclosed sodium progressively disappears, the minimum lamp voltage is prevented from falling below a level equivalent to 70% of the rated lamp voltage, thereby preventing any ballast employed from suffering damage.

What is claimed is:

1. A high pressure sodium vapor lamp having unsaturated vapor pressure type, characteristics in which sodium and mercury are contained in an arc tube made of translucent alumina, said sodium being enclosed in an amount sufficient to exhibit unsaturated vapor pressure type characteristics while said mercury is enclosed in an amount $M_{Hg}$ calculated by the following formula:

$$M_{Hg} \geqq \frac{D^3 \times V_n^2}{(0.204 \times V_{olume} + 13.3)^2 \times L}$$

where $M_{Hg}$: the amount of enclosed mercury (mg)

D: the internal diameter of said arc tube (cm)

L: the electrode-to-electrode distance (cm)

$V_{olume}$: the volume of said arc tube (cc)

$V_n$: the rated lamp voltage (Volt).

2. A high pressure sodium vapor lamp having unsaturated vapor pressure type characteristics according to claim 1, wherein said sodium is enclosed in said arc tube in such an amount that said sodium is completely vaporized during a burning operation.

3. A high pressure sodium vapor lamp having unsaturated vapor pressure type characteristics in which sodium and mercury are contained in an arc tube made of translucent alumina, said sodium being enclosed in said arc tube in such an amount that said sodium is not completely vaporized but is vaporized by 80% or more during the burning operation, said mercury is enclosed in an amount $M_{Hg}$ calculataed by the following formula:

$$M_{Hg} \geqq \frac{D^3 \times V_n^2}{(0.204 \times V_{olume} + 13.3)^2 \times L}$$

where $M_{Hg}$: the amount of enclosed mercury (mg)
D: the internal diameter of said arc tube (cm)
L: the electrode-to-electrode distance (cm)
$V_{olume}$: the volume of said arc tube (cc)
$V_n$: the rated lamp voltage (Volt).

* * * * *